United States Patent [19]

Ohara et al.

[11] Patent Number: 4,926,932

[45] Date of Patent: May 22, 1990

[54] PLATE TYPE HEAT EXCHANGER

[75] Inventors: Toshio Ohara, Kariya; Yoshiyuki Yamauchi, Chita, both of Japan

[73] Assignee: Nippondenso Co., Ltd., Kariya, Japan

[21] Appl. No.: 219,266

[22] Filed: Jul. 15, 1988

[30] Foreign Application Priority Data

Aug. 9, 1987 [JP] Japan ..... 62-199490

[51] Int. Cl.[5] ..... F28B 1/06; F28B 9/08

[52] U.S. Cl. ..... 165/111; 62/285; 165/913

[58] Field of Search ..... 62/285, 288, 289; 165/111, 913

[56] References Cited

U.S. PATENT DOCUMENTS 4,249,597 2/1981 Carey .
4,350,025 9/1982 Izumi ..... 62/285
4,353,224 10/1982 Nonogaki et al. .
4,621,685 11/1986 Nozawa ..... 165/111
4,696,342 9/1987 Yamauchi et al. .
4,723,601 2/1988 Ohara et al. .
4,815,532 3/1989 Sasaki et al. ..... 165/153 X

FOREIGN PATENT DOCUMENTS 50-69744 6/1975 Japan .
2056652 3/1981 United Kingdom .

*Primary Examiner*—Gerald A. Michalsky
*Attorney, Agent, or Firm*—Cushman, Darby & Cushman

[57] ABSTRACT

A heat exchanger for using an evaporator of an automotive air conditioner comprises a plurality of tube units and a plurality of corrugated fins. A pair of plates are connected each other for forming the tube unit. The plate has an elongating portion at an outer peripheral of the connecting portion at which one plate is connected to another plate. The elongating portion elongates from the connecting portion to the corrugated fin, but there exists some gap between the elongating portion and the corrugated fin. So that a draining space is formed within the connecting portion and the elongating portion of the plate and the corrugate fin. Since no surface tension is occurred between the elongating portion and the corrugated fin, the condensed water introduced into the drawing space can be drained effectively.

6 Claims, 4 Drawing Sheets

PLATE TYPE HEAT EXCHANGER

FIELD OF THE INVENTION

The present invention relates to a plate type heat exchanger which is used as an evaporator of an automotive air conditioner, for example.

BACKGROUND OF THE INVENTION

As shown in FIG. 6, a conventional plate type heat exchanger has a plurality of tube units each of which is formed by a couple of plates 101 in which is formed a cup shape portion 401, a plurality of corrugated fins 203 being provided between adjacent pair of the tube units. Plates 101 are connected to each other at a connecting portion 101*a* by brazing, and the corrugated fin 203 and the plate 101 are connected each other. The tube unit has an enlarged portion 101*b* elongating outwardly from the connecting portion 101*a* so that a cup shaped draining space portion 401 is formed within the elongating portion 101*b*, the connecting portion 101*a* and the side surface of the fin 203.

Since the heat exchanger is used as the evaporator of an automotive air conditioner, the moisture within the atmosphere is condensed on the outer surface of the plate 101 and the corrugated fin 203. The condensed water flows toward the down flow of the air passing through the heat exchanger, so that the condensed water is introduced into the draining space 401 which locates at the down flow of the air. The hatched portion in FIGS. 6 and 7 indicates the condensed water. The present inventors have observed that while some condensed water is introduced into the draining space 401 much remains at the end portion of the corrugated fins 203. The present inventors' found that the condensed water remains at the end portion of the corrugated fin 203 because of the surface tension caused at the touching portion between the elongating portion 101*b* and the corrugated fin 203. The droplets remaining on the corrugated fin 203 may disperse toward the passenger's compartment of the automobile, and it, of course, causes serious disadvantages.

In order to solve the disadvantages of the dispersion of the condensed water, it is necessary to eliminate the surface tension which makes the condensed water remain at the end portion of the fin 203.

FIG. 8 shows a type of the heat exchanger which the present inventors had made in an attempt to overcome the problem. The heat exchanger shown in FIG. 8 has no elongating portion so that the connecting portion 101*d* is apart from the corrugated fin 203. According to the present inventors' study, the heat exchanger shown in FIG. 8 cannot solve the problem of dispersion of the condensed water. Since the heat exchanger shown in FIG. 8 has no elongating portion, the draining space 401*x* between the connecting portion 101*d* and the corrugate fin 203 cannot work as effectively as that of the heat exchanger shown in FIG. 6. Therefore, the condensed water generated on the corrugated fin 203 cannot drain downwardly through the draining space 401*x* but disperses toward the passenger's compartment. Furthermore, the tube unit shown in FIG. 8 cannot have an effective sealing efficiency since the coolant within the tube unit may leak through the connecting portion 101*d*.

Since the plates 101 are connected to each other by brazing, and the brazing material is cladded on the surface of the plate 101, a shortage of the total amount of brazing material at the connecting portion 101*d* may occur when the total area of the connecting portion 101*d* is too large.

SUMMARY OF THE INVENTION

The object of the present invention is to provide a plate type heat exchanger which will drain the condensed water effectively. Another object of the present invention is to eliminate the condition of condensed water remaining at the end portion of the corrugated fin due to surface tension at the touching portion between the elongating portion and the corrugated fin.

A further object of the present invention is to provide a plate type heat exchanger wherein the connecting portion of the tube unit is sealed effectively.

A still further object of the present invention is to provide a plate type heat exchanger wherein the end portion of the corrugated fin thereof is well protected by the elongating portion of the tube unit thereof.

In order to attain the above objects, the plate type heat exchanger of the present invention has a plurality of the tube units each of which are formed by a couple of plates, the tube unit has an elongating portion elongating from the connecting portion at which a couple of plates are connected to each other. The elongating portion so elongates toward the corrugated fin from the connecting portion that there exists a gap between the elongating portion and the corrugated fin.

The plate type heat exchanger of the present invention forms a draining space within the elongating portion, the connecting portion and the corrugate fin, so that the generated water condensed on the outer surface of the tube unit and the corrugated fin can drain through the draining space. Since the elongating portion of the present invention does not touch the corrugated fin, no surface tension exists to cause condensed water to remain at the end portion of the corrugated fin.

DETAIL DESCRIPTION OF THE PREFERRED EMBODIMENT

Figure 1:
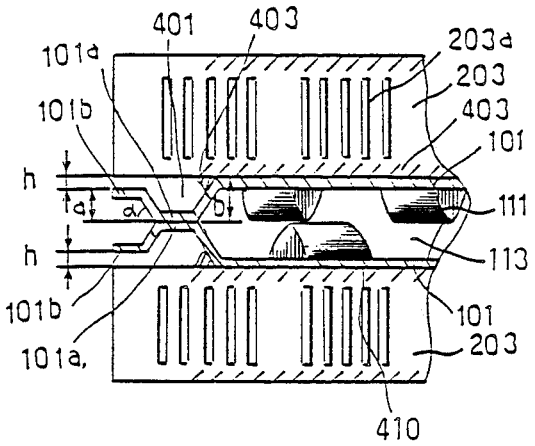
FIG. 1 is a sectional view showing a part of the heat exchanger of the present invention.
Figure 2:
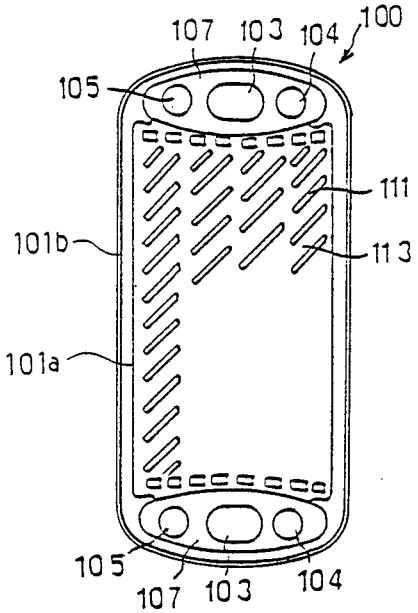
FIG. 2 is a front view of the plate shown in FIG. 1.
Figure 3:
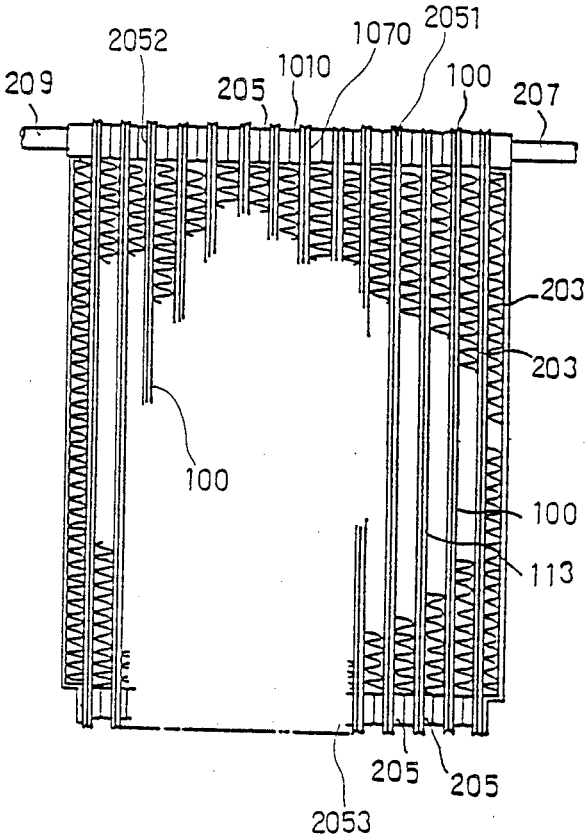
FIG. 3 is a front view of the heat exchanger of the present invention.

The heat exchanger has a plurality of tube units 100 and a plurality of corrugated fins 203 which are provided between adjacent pairs of the tube units 100, as shown in FIG. 3. The tube unit 100 is formed by a pair of plates 101 made of aluminum alloy. The brazing material is cladded on both the outer surface and inner surface of the plate 101 in such a manner that the thickness of the brazing material is about 10–15% of the thickness of the core material of the plate 101. The plate cladded by the brazing material is pressed for forming a tank portion 107 and a tube portion 113 as shown in FIG. 2. The tank portion 107 is provided at both end portions of the plate 101, and the tube portion 113 is provided between the tank portions 107. A plurality of ribs 111 are formed at the tube portion, the ribs 111 protrude inwardly so that the top surface of the rib of one plate 101 is touched to the top surface of the rib 111 of another plate 101 when the plates 101 are connected to each other as shown in FIG. 1. Since the rib 111 inclines from the axial line of the tube portion 113, and since the inclining direction of the rib 111 of one of a pair of plates 101 is opposite to the inclining direction of the rib 111 of another one of a pair of plates 111, the rib 111 of one of a pair of plates 101 touches the corresponding rib 111 with a small amount of connecting area.

Through holes 103, 104 and 105 are formed at the tank portion 107 so that the adjacent tank 205 are connected to each other through the through holes 103, 104 and 105. The plate 1010 provided at the center portion of the heat exchanger (shown in FIG. 3) has no through holes 103, 104 and 105 at the upper side of the tank portion 1070. So that the upper tank 205 is divided into two parts an inlet tank portion 2051 and an outlet portion 2052. Every plate 101, on the other hand, has the through holes 103, 104 and 105 at the lower tank portion 107 so that the lower tank 203 forms a single unit of a intermediate tank 2053. Numeral 207 shows an inlet pipe which connects to the tank portion 107 of the inlet tank 2051, numeral 209 shows an outlet pipe which connects to the tank portion 107 of the outlet tank 2052.

As shown in FIG. 2, the plate 101 has a connecting portion 101*a* around the outer peripheral of the plate 101. The width of the connecting portion 101*a* is about 1–2 mm. The plate 101 has an elongating portion 101*b* at an outer side of the connecting portion 101*a*. The width of the elongating portion 101*b* is about 1 mm. The elongating portion 101*b* elongates from the connecting portion 101*a* to the corrugated fin 203 in such a manner that the inclining degree $\alpha$ of the elongating portion 101*b* is about 60°. The elongating portion 101*b* is bent at an intermediate portion thereof so that the end portion 101*b*$_1$ of the elongating portion 101*b* elongates parallel with the air flow passing through the corrugated fin 203. The height a of the elongating portion 101*b* is about 1 mm which is shorter than the height b of the tube portion 107 which is about 1.5–2.0 mm, so that a gap of about 0.5–1 mm is formed between the side surface of the end portion 101*b* of the elongating portion 101*b* and the side surface of the corrugated fin 203.

The heat exchanger is produced by the steps explained hereinafter. A tube unit 100 is formed by attaching the plate 101 to the corresponding plate 101. Then a plurality of tube units 100 and a plurality of corrugated fins 203 are alined in such a manner that the corrugated fin 203 is provided between adjacent pair of the tube units 100, the inlet pipe 207 and the outlet pipe 209 are connected to the tank 2051 and 2052 respectively. The assembled heat exchanger is then conveyed into a furnace for melting the brazing material cladded on the both the inner surface and the outer surface of the plate 101.

The brazing material cladded on the outer surface of the plate 101 connects the corrugated fin 203 to the outer surface of the plate 101, the brazing material cladded on the inner surface of the plate 101 connects the ribs 111 to the corresponding ribs 111 and connects the plates 101 to the corresponding plate 101 at the connecting portion 101*a*.

Since the brazing material cladded on the inner surface of the elongating portion 101 flows toward the connecting portion 101*a* by the surface tension thereof, enough brazing material is supplied at the connecting portion 101*a*. Thereby the plates 101 are connected to each other effectively. The inlet tube 207 is connected to the tank 2051 by the brazing material cladded on the outer surface of the plates 101, and the outlet pipe 209 is also connected to the tank 2052 by the brazing material cladded on the outer surface of the plates 101.

The function of the heat exchanger is explained hereinafter. The refrigerant coolant is introduced into the inlet tank 2051 through the inlet pipe 207 from an expansion valve of a refrigerant circuit (not shown). The refrigerant coolant introduced into the inlet tank 2051 then flows toward the intermediate tank 2053 through a tube portion of the tube unit 100. The refrigerant introduced into the intermediate tank 2053 then flows toward the outlet tank 2052 through the tube portion 113 of the tube unit 100. The refrigerant flow introduced into the outlet tank 2052 then flows toward a compressor of a refrigerant circuit (not shown) through the outlet pipe 209.

Since the heat exchanger is positioned within the air flow flowing toward the passengers compartment, the refrigerant coolant flowing through the heat exchanger is evaporated by receiving the heat from the air. In other words, the air flowing through the heat exchanger is cooled by the refrigerant.

Figure 4:
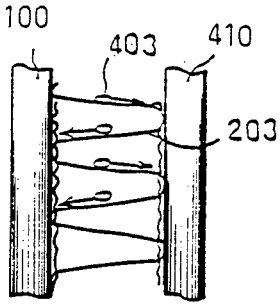
FIG. 4 is a front view of a part of the heat exchanger shown in FIG. 3.

The moisture contained in the air is condensed on the outer surface of the tube unit 100 and the corrugated fin 203. The condensed water 403 flows toward a contacting area 410 at which the corrugated fin 203 contacts to the tube unit 100 by the surface tension, as shown in FIGS. 1 and 4. The condensed water 403 at the contacting area 410 then flows toward the draining space 401. The air flow conveys the condensed water 403 toward the draining space 401. The condensed water introduced into the draining space is then flowed downwardly by the gravity thereof.

Since the elongating portion 101*b* forms the draining space 401, the condensed water introduced into the draining space 401 is well prevented from the situation that the water disperses toward the passenger's compartment with the air flow. Furthermore, since the elongating portion 101*b* is apart from the corrugated fin 203, no surface tension is generated between the elongating portion 101*b* and the corrugated fin 203. So that the draining of the condensed water in the draining portion 401 is not hindered by the surface tension of the elongating portion 101*b*. No condensed water is, therefore, held between the corrugated fin 203 and the elongating portion 101*b*.

Figure 7:
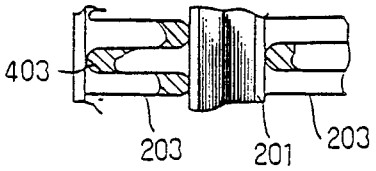
FIG. 7 (PRIOR ART)
FIG. 7 is a side view of the heat exchanger shown in FIG. 6.
Figure 8:
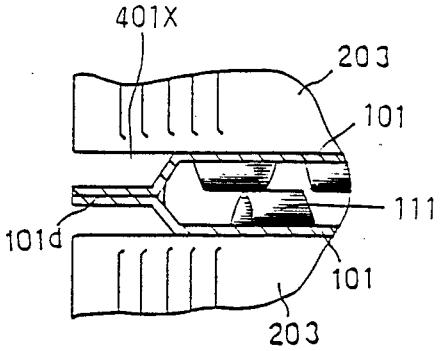
FIG. 8 is a sectional view of a part of the heat exchanger which the present inventors had made on the way to complete the present invention.

Furthermore, since not much condensed water exists on the corrugate fin 203, the passage area of air flow flowing the corrugated fin 203 is not reduced by the condensed water. The passage area of the air flow may be reduced by the condensed air if much water is held on the corrugated fin 203 such as shown in FIG. 7.

Figure 5:
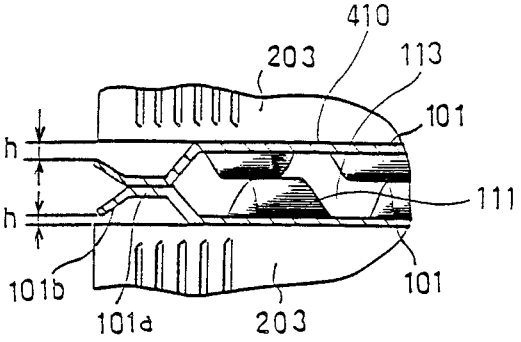
FIG. 5 is a sectional view showing another embodiment of the heat exchanger of the present invention.
Figure 6:
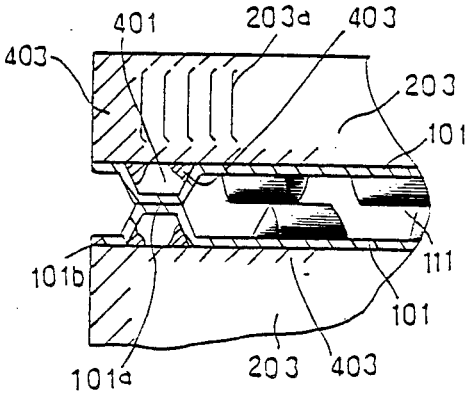
FIG. 6 (PRIOR ART)
FIG. 6 is a sectional view of the conventional type of heat exchanger.

FIG. 5 shows another embodiment of the heat exchanger. The elongating portion 101*b* of the heat exchanger shown in FIG. 5 is not bent but just elongates toward the corrugated fin 203. The heat exchanger shown in FIG. 5 also has draining efficiency as well as that shown in FIG. 1.

Figure 9:
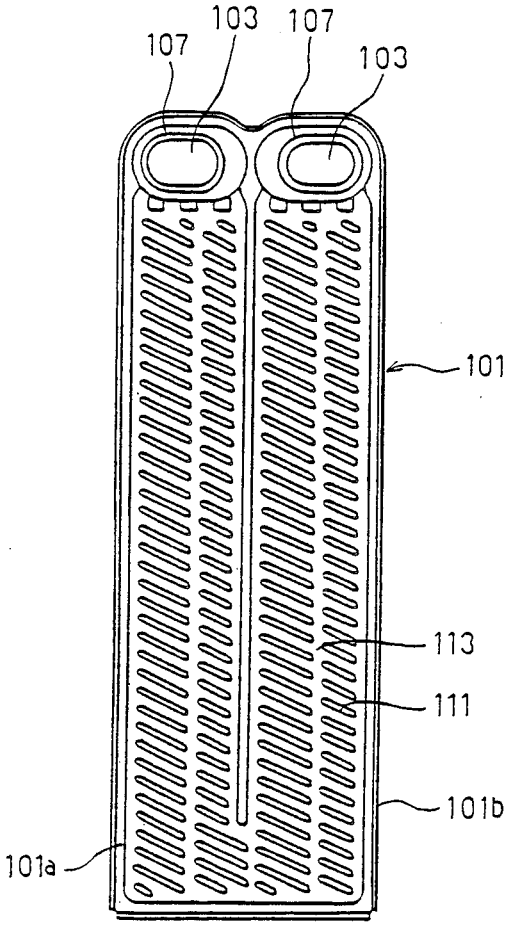
FIG. 9 is a front view of a plate of another embodiment of the present invention.

It should be noted that the heat exchanger of the present invention is not limited to the type shown in FIG. 3. The heat exchanger having a plurality of intermediate tanks can also employ the present invention. The heat exchanger having a tank portion at a one side of the plate (shown in FIG. 9) can also employ the present invention.

What is claimed is:

1. A plate type heat exchanger comprising:

a plurality of tube units for forming a tank portion to which fluid is introduced and a tube portion through which passes fluid introduced into said tank portion; and a corrugated fin having bent portions and straight portions for promoting heat exchange between the fluid within said tube portion and air passing through said corrugated fin, said bent portions being connected at an outer surface of each of said tube units at said tube portion thereof and each of said straight portions extending from one of said bent portions to an adjacent bent portion;

each of said tube units being formed by a pair of plates each having a connecting portion at which said pair of plates are connected to each other continuously around an outer periphery of said plates;

the connecting portion at least one of said pair of plates being transversely spaced a predetermined amount from its adjacent corrugated fin which extends outwardly beyond said connecting portion; and said one plate having at an outer side of its said connecting portion an elongated portion angling outward from its said connecting portion toward said corrugated fin and forming therewith a predetermined gap which is smaller than said predetermined amount and further forming with its said connecting portion and its said corrugated fin a draining space for draining water condensed on the outer surface of the tube unit and the corrugated fin.

2. A plate type heat exchanger claimed in claim 1, wherein:

said gap between said elongated portion and said corrugated fin is about 1 mm.

3. A plate type heat exchanger claimed in claim 1, wherein:

said pair of plates are connected to each other by brazing, and said corrugated fin is connected to said tube unit by brazing.

4. A plate type heat exchanger claimed in claim 1, wherein:

an end portion of said elongated portion coincides with an end portion of said corrugated fin.

5. A plate type heat exchanger as in claim 1 wherein said elongated portion angles as aforesaid straight to its outer end which forms said predetermined gap with the adjacent corrugated fin.

6. A plate type heat exchanger as in claim 1 wherein said elongated portion includes two sections the first of which angles as aforesaid and the second of which extends from the first section parallel to the adjacent corrugated fin with said predetermined gap therebetween.

* * * * *